US008118717B1

(12) United States Patent
Lai

(10) Patent No.: US 8,118,717 B1
(45) Date of Patent: Feb. 21, 2012

(54) DUMBBELL WITH ROTATABLE WEIGHTS

(76) Inventor: Shu-Chiung Liao Lai, Taichung (TW)

( * ) Notice: Subject to any disclaimer, the term of this patent is extended or adjusted under 35 U.S.C. 154(b) by 0 days.

(21) Appl. No.: 13/007,756

(22) Filed: Jan. 17, 2011

(51) Int. Cl.
*A63B 21/075* (2006.01)

(52) U.S. Cl. ..... 482/108

(58) Field of Classification Search ..... 482/106–108; D21/679–682
See application file for complete search history.

(56) References Cited

U.S. PATENT DOCUMENTS 850,964 A * 4/1907 Pelletier et al. ..... 482/108
1,058,786 A * 4/1913 Newkirk et al. ..... 482/108
3,482,835 A * 12/1969 Dean ..... 482/108
3,488,051 A * 1/1970 Papistas-Scherer ..... 482/108
4,482,151 A * 11/1984 Zwilling ..... 482/106
4,566,690 A * 1/1986 Schook ..... 482/108
5,180,352 A * 1/1993 Sreter ..... 482/108
5,871,423 A * 2/1999 Pruchnik ..... 482/110
5,879,274 A * 3/1999 Mattox ..... 482/107
6,179,758 B1 * 1/2001 Domenge ..... 482/110
7,604,577 B2 * 10/2009 Lin ..... 482/108

* cited by examiner

*Primary Examiner* — Allana Lewin

(57) ABSTRACT

A dumbbell includes a bar, an axle, two weights and two cover. The bar includes a holding portion and two enlarged reception members connected to two ends of the bar. The axle extends through a passage of the bar and each reception member has a space for reception of the weight. Each weight includes a ridge and a weight body, the ridge is connected between the axle and the weight body. The two covers are respectively connected to the reception members to cover the two respective spaces. The weights are rotatable during using the dumbbell and the rotation exercises more muscles of the user's body.

8 Claims, 10 Drawing Sheets

DUMBBELL WITH ROTATABLE WEIGHTS

BACKGROUND OF THE INVENTION (1) Field of the Invention

The present invention relates to a dumbbell, and more particularly, to a dumbbell with rotatable weights on two ends of the bar so as to exercise muscles of the users.

(2) Description of the Prior Art

A conventional dumbbell is shown in FIG. 1 and generally includes a bar 10 with two weights 11 on two ends of the bar 10, wherein the weights 11 each are a circular disk-like weight, spherical weights or polygonal disk-like weights. However, the use of the dumbbell is simply and boring, the dumbbell is held at the bar and moves the arms up and down. Only the muscles of the arms are exercised and this cannot be satisfied by most of the users who want to exercise more muscles of the body.

The present invention intends to provide a dumbbell which is designed to overcome the shortcomings of the conventional dumbbell and can exercise more muscles.

SUMMARY OF THE INVENTION

The present invention relates to a dumbbell and includes a bar, an axle, two
weights and two cover. The bar includes a holding portion and two enlarged reception members connected to two ends of the bar. The axle extends through a passage of the bar and each reception member has a space for reception of the weight. Each weight includes a ridge and a weight body, the ridge is connected between the axle and the weight body. The two covers are respectively connected to the reception members to cover the two respective spaces.

When the dumbbell is operated, the weights are rotatable and generate eccentric force to swing the dumbbell and the swinging action of the dumbbell is transferred to the user's body to vibrate and exercise the user's body. There are different ways to operate the dumbbell to train the user to keep balance which provides more interest to the user.

Each of the weights can be composed of multiple identical plates so that the user can optionally use desired weights.

The weight body of each weight is a curved body and the ridge is connected to a middle of the concaved inside of the weight body so that each weight is an anchor-like weight which has an off-center weight center to the dumbbell to have better swinging feature.

The weights can be made into different ponds for the user to choose.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
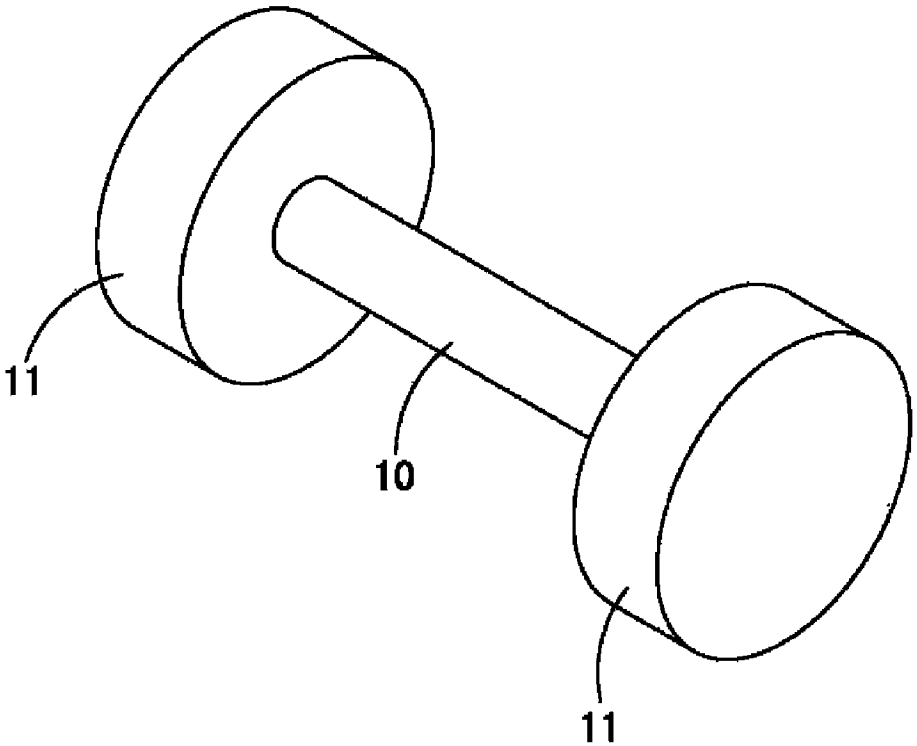
FIG.1 Prior Art
FIG. 1 is a perspective view to show a conventional dumbbell.
Figure 2:
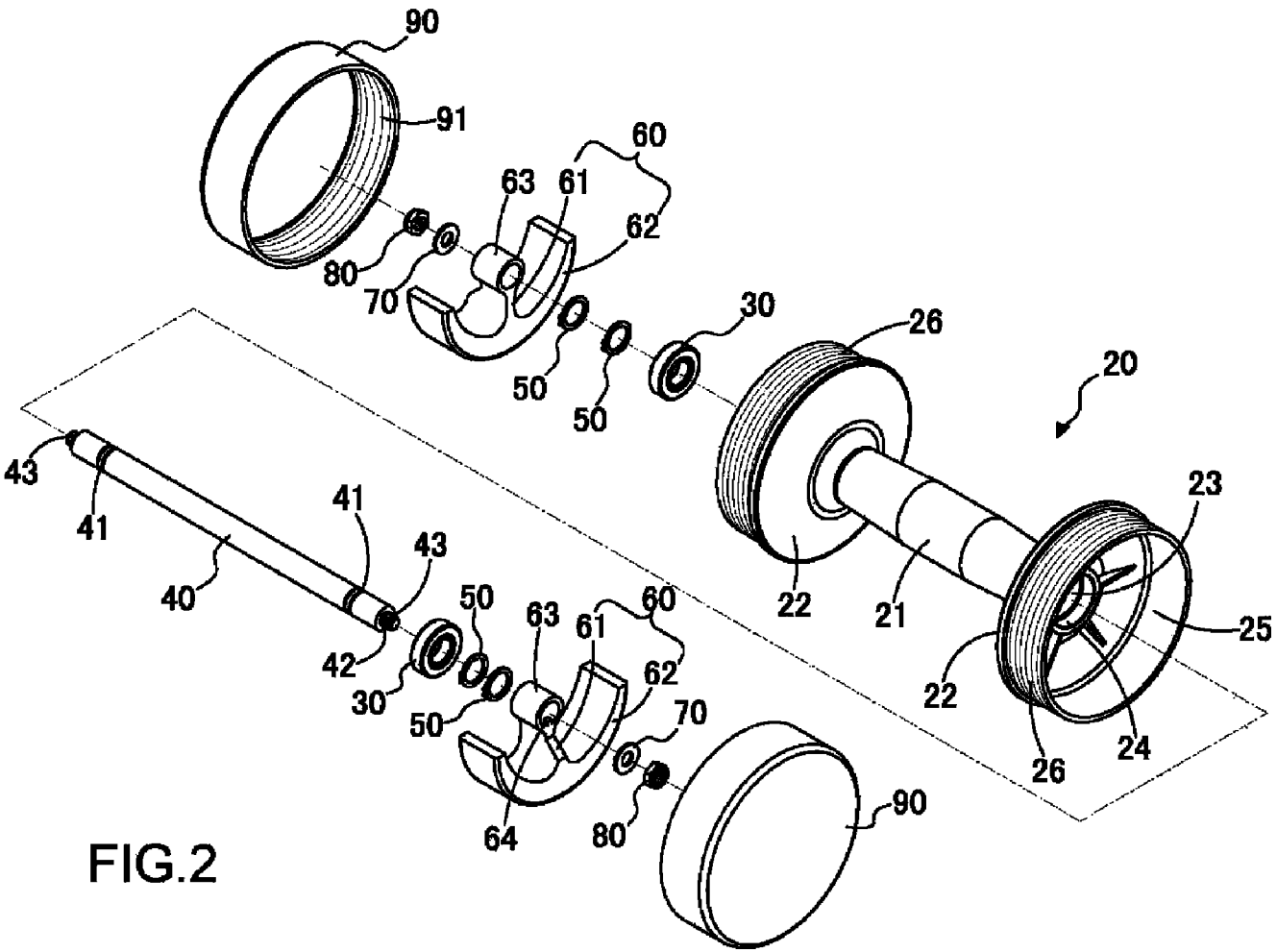
FIG. 2 is an exploded view to show the dumbbell of the present invention.
Figure 3:
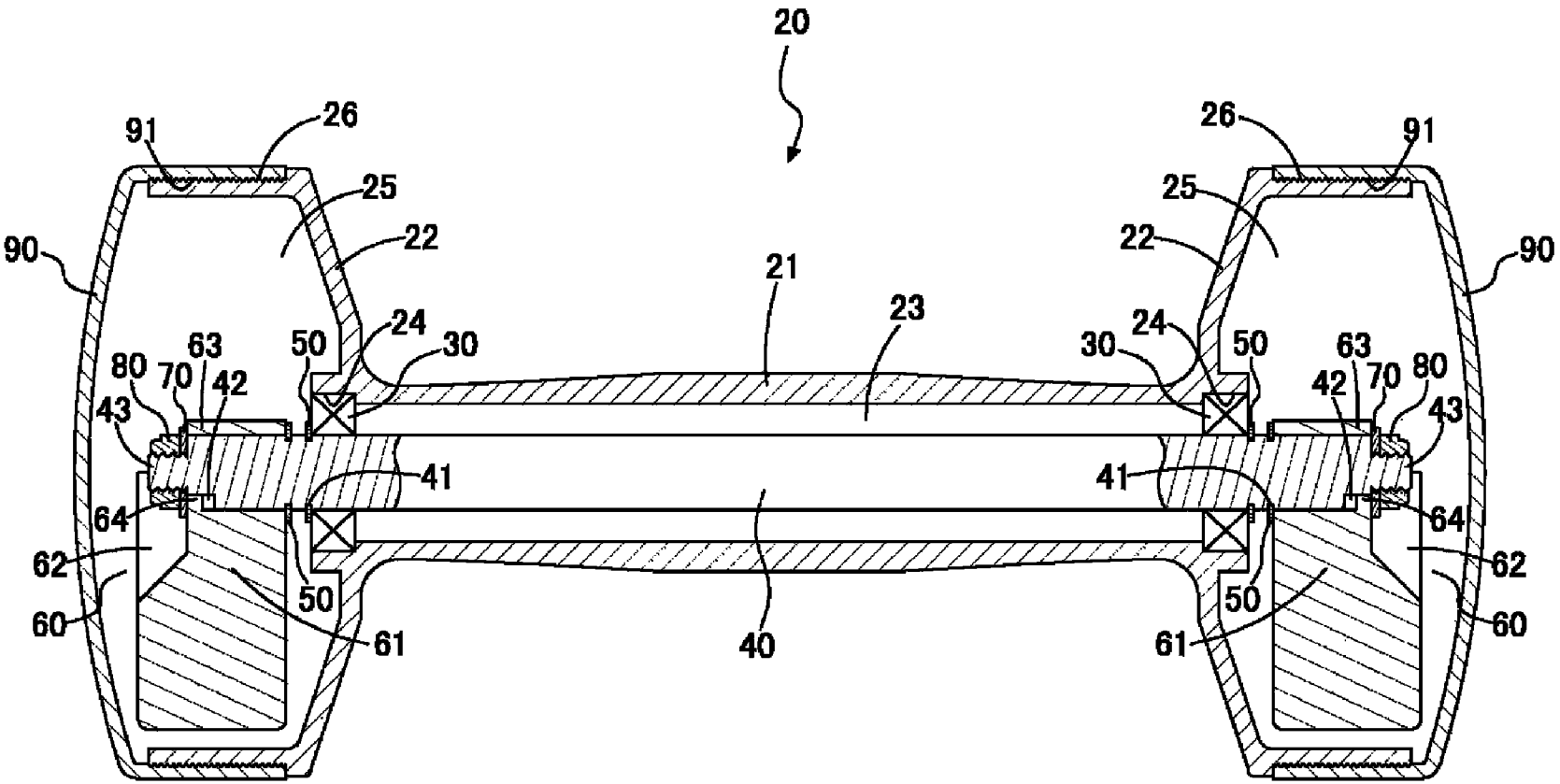
FIG. 3 is a cross sectional view of the dumbbell of the present invention.

Referring to FIGS. 2 and 3, the dumbbell of the present invention comprises a bar 20, two bearings 30, an axle 40, two C-clips 50, two weights 60, two washers 70, two nuts 80 and two covers 90. The bar 20 includes a holding portion 21 and two enlarged reception members 22 connected to two ends of the bar 20. The bar 21 has a passage 23 axially defined therethrough and each reception member 22 has a space 25 defined therein which opens outward. The space 25 communicates with the passage 23 and the passages 23 communicates with two bearings 24 located at two ends of the passage 23. Each of the two reception members 22 has outer threads 26. The two bearings 30 are located in the bearing spaces 24

The axle 40 rotatably extends through the passage 23 and two ends of the axle 40 extend through the two bearings 30 and are located in the spaces 25 of the two reception members 22. The axle 40 includes two grooves 41 respectively located close to two ends thereof and each end of the axle 40 has a notch 42 defined therein. A threaded rods 43 extends from each end of the axle 40.

The four C-clips 50 are engaged with the four grooves 41 and two C-clips 50 located close to the middle of the axle 40 are in contact with two respective outsides of the two bearings 30, and a distance is defined between the two inside C-clips 50 and the two outside C-clips 50.

The two weights 60 fixed to the two ends of the axle 40 and each weight 60 includes a ridge 61 and a weight body 62. The ridge 61 is connected between the axle 40 and the weight body 62. Each of the ridges 61 has a tubular portion 63 to which the axle 40 is connected. Each tubular portion 63 has a protrusion 64 which is engaged with the notch 42 when the axle 40 is inserted into the tubular portion 63. The two outside C-clips 50 are in contact with the two respective insides of the two tubular portions 63. The weight body 62 of each weight 60 is a curved body and the ridge 61 is connected to the middle of the concaved inside of the weight body 62 such that each weight 60 is an anchor-like weight.

The two washers 70 are mounted to the two threaded rods 43 and cooperated with the two C-clips 50 to restrict the two weights 60 on the two ends of the axle 40. The two nuts 80 are threadedly mounted to the two threaded rods 43 and secure the two washers 70.

The two covers 90 each have inner threads 91 so that the two covers 90 are threadedly mounted to the outer threads 26 of the reception members 22. The two covers 90 can also be secured to the reception members 22 by way of high-frequency welding.

Figure 4:
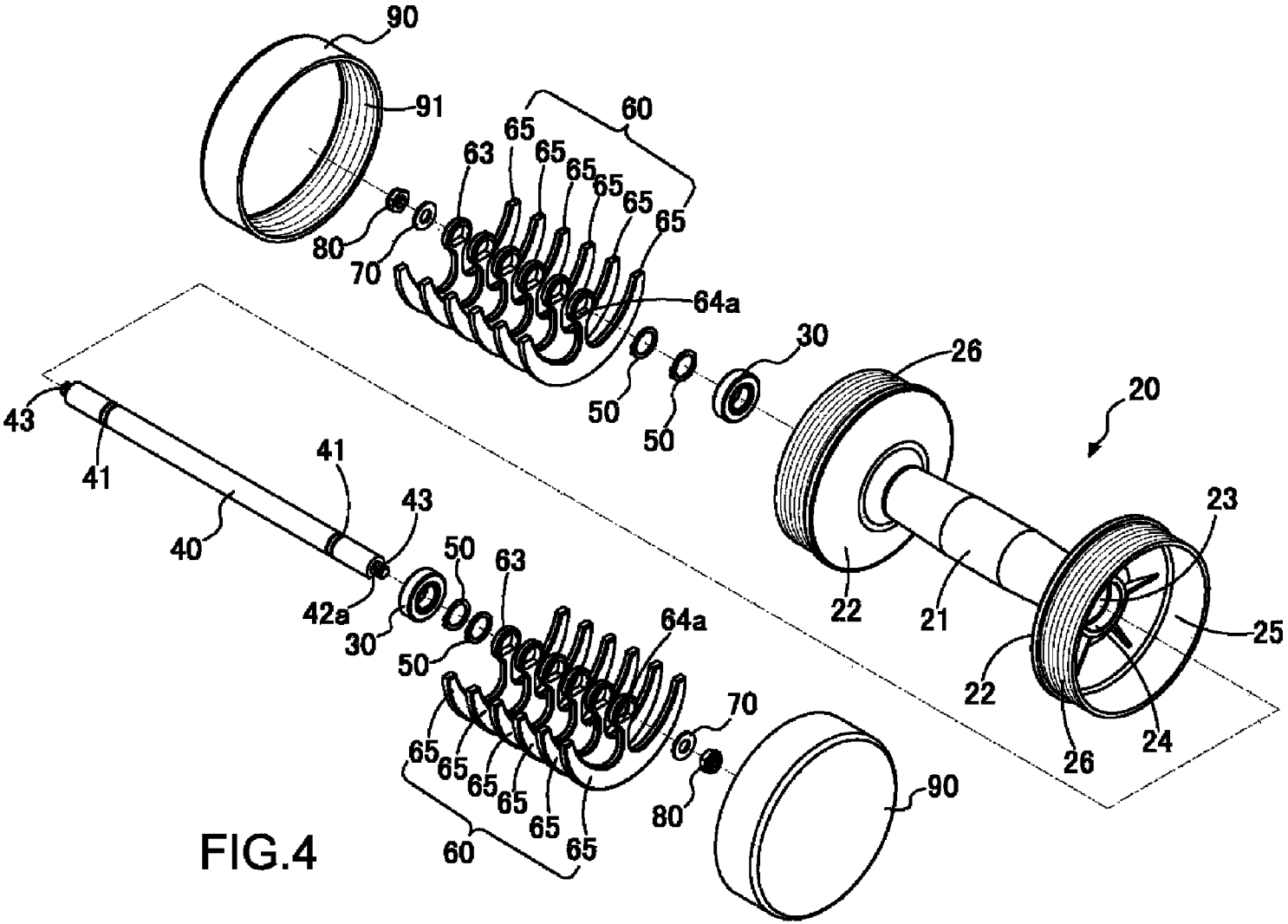
FIG. 4 is an exploded view to show the second embodiment of the dumbbell of the present invention.
Figure 5:
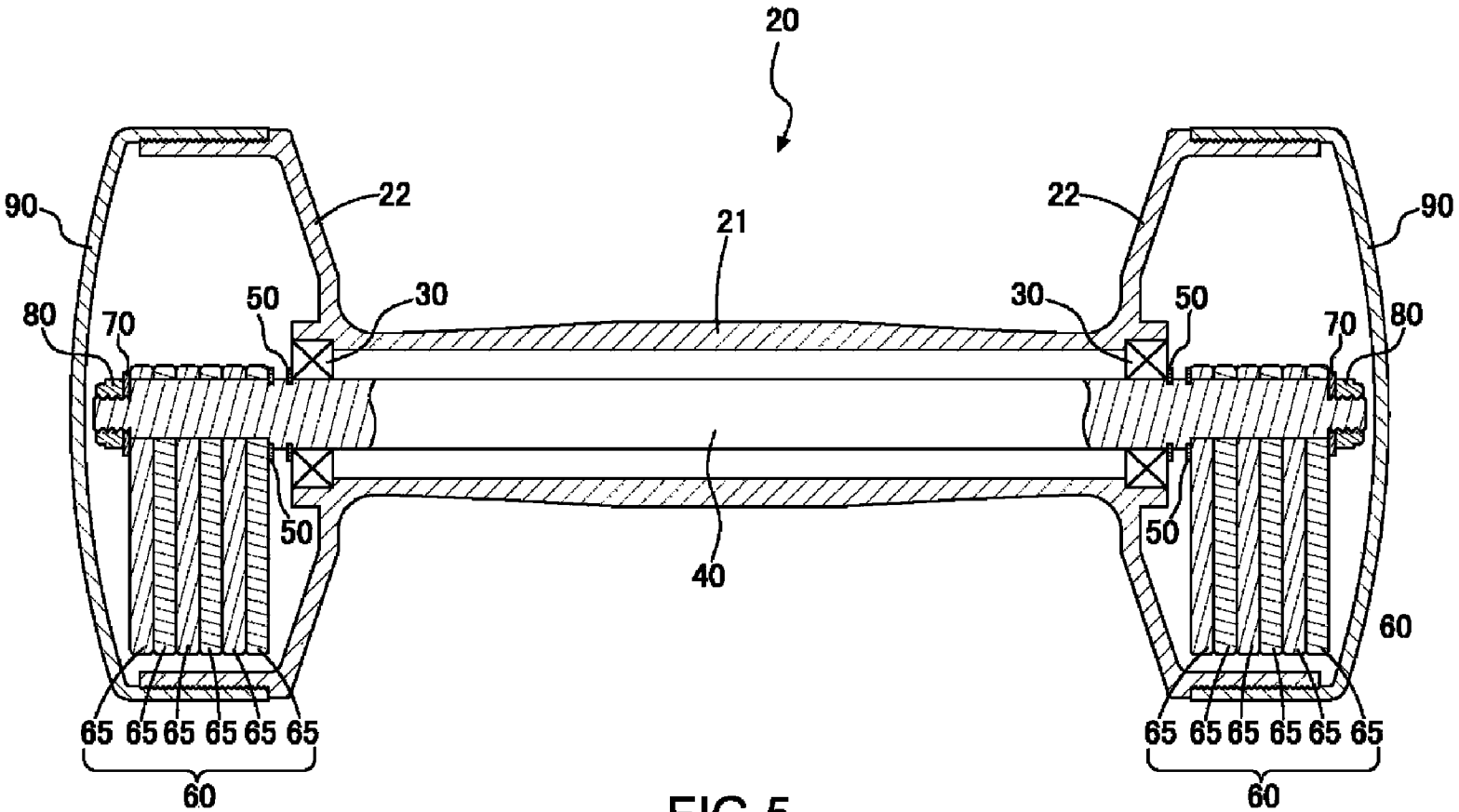
FIG. 5 is a cross sectional view of the dumbbell in FIG. 4 of the present invention.

As shown in FIGS. 4 and 5, the second embodiment of the present invention is similar to the first embodiment and the differences are that each of the weights 60 is composed of multiple identical weight plates 65, and the two ends of the axle 40 each have a first surface 42*a*, and each of the ridges 61 has a tubular portion 63 to which the axle 40 is connected. Each tubular portion 63 has a second surface 64*a* which is matched with the first surface 42*a* when the axle 40 is inserted into the tubular portion 63. Therefore, the users can choose desired number of the weight plates 65. After use, multiple tubular portions or washers (not shown) can be mounted to the axle 40 to secure and position the weight plates 65 on the axle 40. In this embodiment, the number of the weight plates 65 is six.

Figure 6:
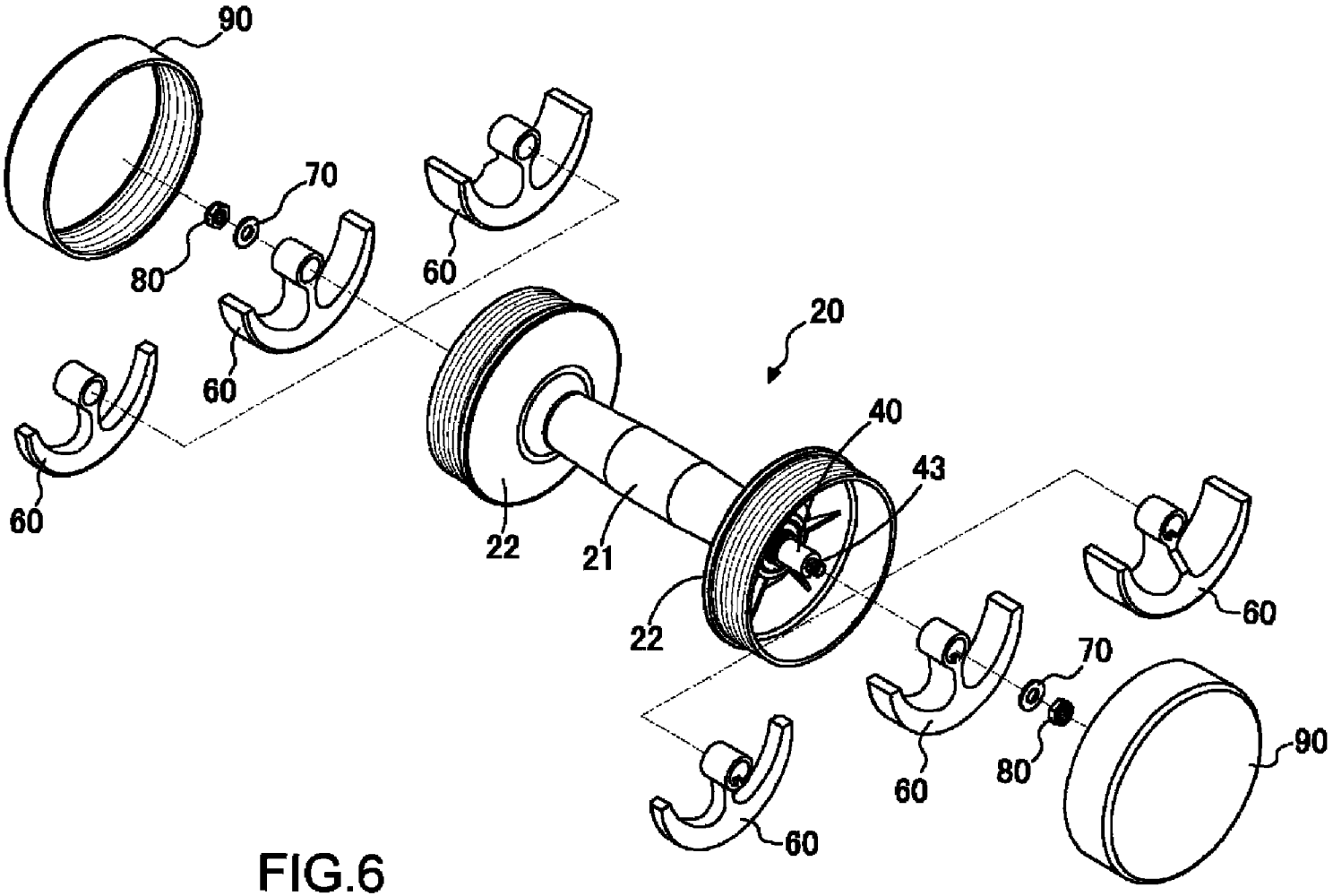
FIG. 6 is an exploded view to show the third embodiment of the dumbbell of the present invention.

As shown in FIG. 6, the third embodiment of the present invention is similar to the first embodiment and the difference is that the weights 60 can be made to include different weight for the users to choose.

Figure 7:
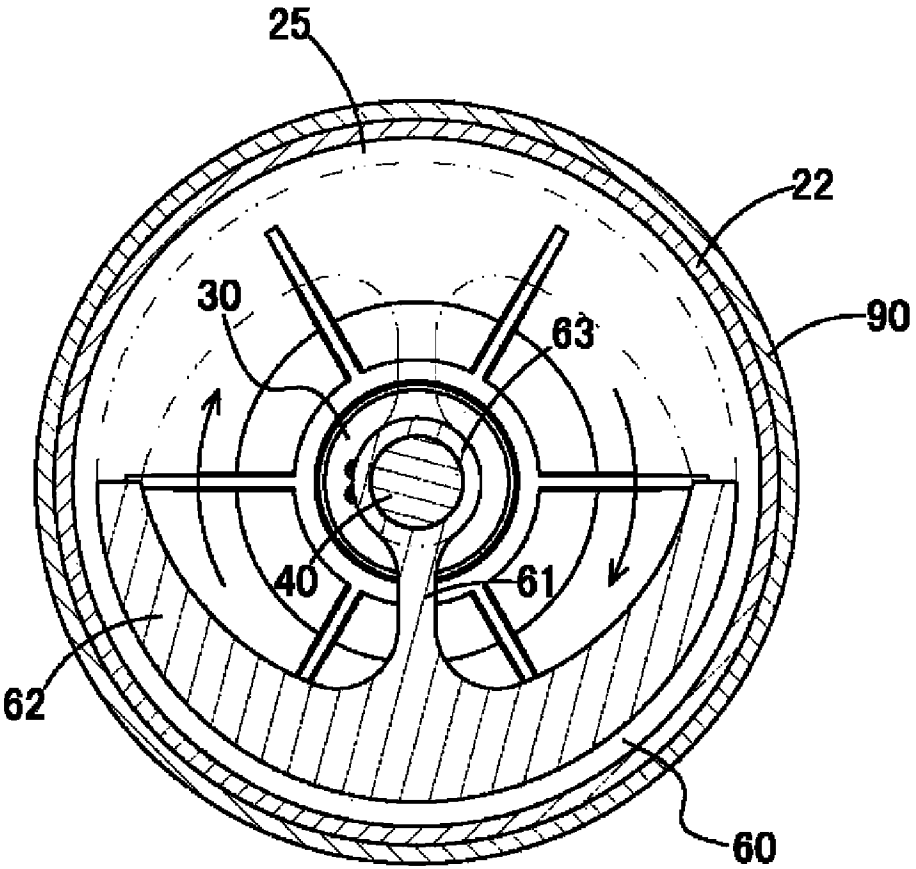
FIG. 7 is an end cross sectional view of the dumbbell of the present invention.

When the user holds the bar 20 and operates the dumbbell, the two weights 60 in the spaces 25 are rotated about the axle 40 as shown in FIG. 7. The rotation of the two weights 60 generates eccentric force to swing the dumbbell and the swinging action is transferred to the user's body so that the muscles of the user's body slightly shake and are exercised. There are several ways to operate the dumbbell as shown in FIGS. 8 to 11. The anchor-like weight bodies 62 generate larger eccentric force and train the user to keep balance.

Figure 8:
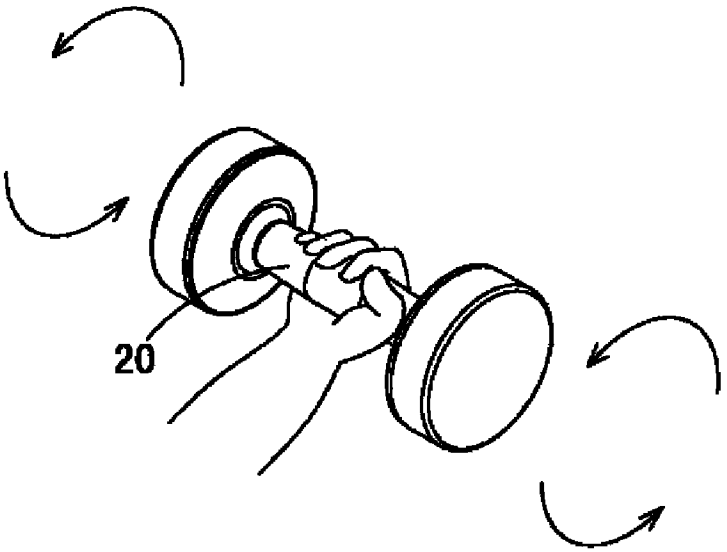

As shown in FIG. 8, the user holds the bar 20 by one hand to arrange the dumbbell horizontally and the hand holding the dumbbell move right and left or back and forth repeatedly to let the weights 60 to rotate.

Figure 9:
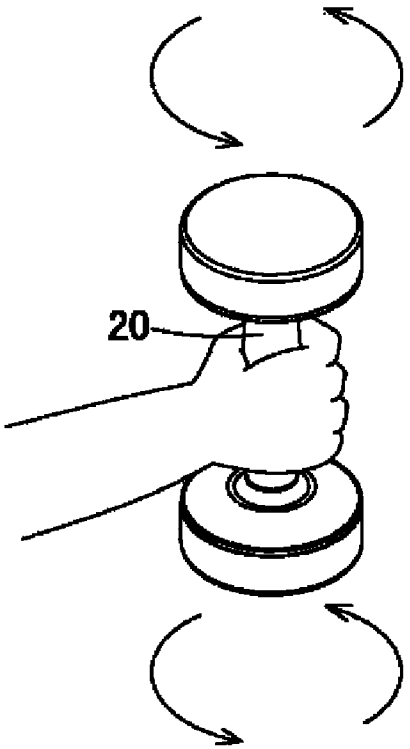
FIGS. 8 to 11 show different ways of operation of the dumbbell of the present invention.

As shown in FIG. 9, the user holds the bar 20 by one hand to arrange the dumbbell upright and the hand holding the dumbbell move right and left or back and forth repeatedly to let the weights 60 to rotate.

Figure 10:
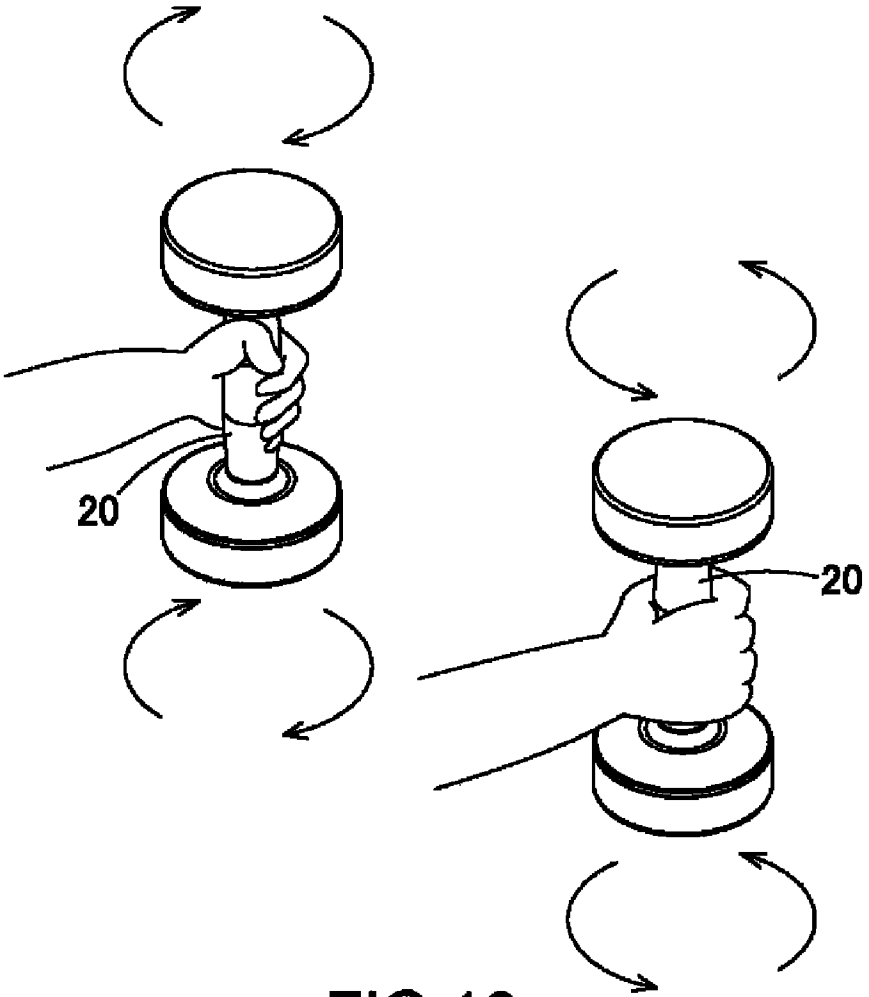

As shown in FIG. 10, the user holds the two bars 20 by two hands and arranges the dumbbells upright, and the hands holding the dumbbells move right and left or back and forth repeatedly to let the weights 60 to rotate.

Figure 11:
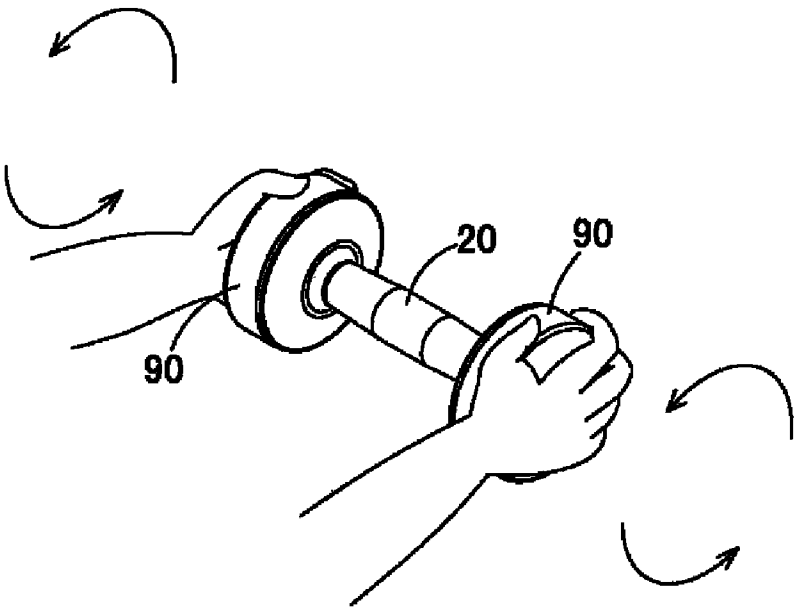

As shown in FIG. 11, the user holds the two covers 90 by two hands and two hands operate the dumbbells right and left or back and forth repeatedly to let the weights 60 to rotate.

While we have shown and described the embodiment in accordance with the present invention, it should be clear to those skilled in the art that further embodiments may be made without departing from the scope of the present invention.

What is claimed is:

1. A dumbbell comprising:

a bar having a holding portion and two enlarged reception members connected to two ends of the bar, the bar having a passage axially defined therethrough, each reception member having a space defined therein which opens outward;

an axle rotatably extending through the passage and two ends of the axle located in the spaces of the two reception members;

a weight fixed to each of the two ends of the axle and each weight including a ridge and a weight body, the ridge connected between the axle and the weight body, the weight body of each weight being a curved body and the ridge connected to a middle of a concaved inside of the weight body, each of the two ends of the axle including a notch and each of the ridges having a tubular portion to which the axle is connected, each tubular portion having a protrusion which is engaged with the notch when the axle is inserted into the tubular portion, and two covers respectively connected to the reception members to cover the two respective spaces.

2. The dumbbell as claimed in claim 1, wherein each of the weights is composed of multiple identical weight plates.

3. The dumbbell as claimed in claim 1 further comprising two bearings, two C-clips, two washers and two nuts, the axle including two grooves respectively located close to two ends thereof, each end of the axle having a threaded rods extending therefrom, the two bearings located in the two passages of the bar and mounted to the two ends of the axle, the two C-clips engaged with the two grooves and contacting two respective outsides of the two bearings, the two washers mounted to the two threaded rods and cooperated with the two C-clips to restrict the two weights on the two ends of the axle, the two nuts threadedly mounted to the two threaded rods and securing the two washers.

4. The dumbbell as claimed in claim 3 further comprising two extra grooves being defined beside the two existed grooves, two extra C-clips engaged with the two extra grooves, a gap being defined between the bearing and the weight on each end of the axle by the four C-clips.

5. The dumbbell as claimed in claim 4, wherein the two covers are threadedly mounted to the reception members.

6. The dumbbell as claimed in claim 1, wherein the two ends of the axle each have a first surface and each of the ridges has a tubular portion to which the axle is connected, each tubular portion has a second surface which is matched with the first surface when the axle is inserted into the tubular portion.

7. The dumbbell as claimed in claim 6 further comprising two bearings, two C-clips, two washers and two nuts, the axle including two grooves respectively located close to two ends thereof, each end of the axle having a threaded rods extending therefrom, the two bearings located in the two passages of the bar and mounted to the two ends of the axle, the two C-clips engaged with the two grooves and contacting two respective outsides of the two bearings, the two washers mounted to the two threaded rods and cooperated with the two C-clips to restrict the two weights on the two ends of the axle, the two nuts threadedly mounted to the two threaded rods and securing the two washers.

8. The dumbbell as claimed in claim 7 further comprising two extra grooves being defined beside the two existed grooves, two extra C-clips engaged with the two extra grooves, a gap being defined between the bearing and the weight on each end of the axle by the four C-clips.

* * * * *